US008240453B2

(12) United States Patent
Miyaji

(10) Patent No.: US 8,240,453 B2
(45) Date of Patent: Aug. 14, 2012

(54) FILM FOR CLEANING GUIDE ROLLERS OF ESCALATOR

(75) Inventor: Nobuo Miyaji, Tokyo (JP)

(73) Assignees: Vistec Co., Ltd., Tokyo (JP); Videca Co., Ltd, Tokyo (JP)

( * ) Notice: Subject to any disclaimer, the term of this patent is extended or adjusted under 35 U.S.C. 154(b) by 0 days.

(21) Appl. No.: 12/918,373

(22) PCT Filed: Feb. 20, 2009

(86) PCT No.: PCT/JP2009/052970

§ 371 (c)(1),
(2), (4) Date: Sep. 20, 2010

(87) PCT Pub. No.: WO2009/104716

PCT Pub. Date: Aug. 27, 2009

(65) Prior Publication Data

US 2011/0023255 A1 Feb. 3, 2011

(30) Foreign Application Priority Data

Feb. 22, 2008 (JP) ..... 2008-041796

(51) Int. Cl.
*B66B 31/02* (2006.01)

(52) U.S. Cl. ..... 198/337; 198/335; 198/338

(58) Field of Classification Search ..... 198/335, 198/336, 337, 338, 494, 496
See application file for complete search history.

(56) References Cited

U.S. PATENT DOCUMENTS

| | | | | |
|---|---|---|---|---|
| 5,160,009 | A * | 11/1992 | Iyoda et al. | 198/337 |
| 5,743,064 | A * | 4/1998 | Bennett | 52/718.04 |
| 6,450,228 | B1 * | 9/2002 | McLeod et al. | 156/356 |
| 7,108,905 | B2 | 9/2006 | McLeod | |
| 7,134,539 | B2 * | 11/2006 | Kim | 198/338 |
| 7,278,528 | B2 * | 10/2007 | McLeod et al. | 198/337 |
| 7,951,254 | B2 * | 5/2011 | Ball et al. | 156/247 |

FOREIGN PATENT DOCUMENTS

| | | |
|---|---|---|
| JP | 61-267681 | 11/1986 |
| JP | 61-267682 | 11/1986 |
| JP | 08-259162 | 10/1996 |
| JP | 3044167 | 12/1997 |
| JP | 11060136 | 3/1999 |
| JP | 2005-287531 | 10/2005 |

OTHER PUBLICATIONS 2 sheets—of Japanese Office Action for JP2008-041796.
2 sheets—of English translation of Office action for JP2008-041796.

* cited by examiner

*Primary Examiner* — Douglas Hess
(74) *Attorney, Agent, or Firm* — Sturm & Fix LLP

(57) ABSTRACT

A film for cleaning guide rollers of escalator can be detachably stuck over a predetermined length in a direction of transporting of a handrail belt, to the endless handrail belt which is guided and transported by guide rollers installed at a lower side of steps of an escalator (E) and a belt guide which is installed at an upper side of the steps, and includes a removing film layer which scrapes substances adhered to an outer circumferential surface of the guide rollers.

3 Claims, 7 Drawing Sheets

FILM FOR CLEANING GUIDE ROLLERS OF ESCALATOR

TECHNICAL FIELD

The present invention relates to a film for cleaning guide rollers of an escalator, which is mounted temporarily on a handrail belt of the escalator, and which cleans the guide rollers by a transporting operation of a handrail belt.

BACKGROUND ART

Escalators have been widely used to move or transport people and goods up and down in buildings. FIG. 14 is a perspective view showing a conventional example of an escalator E which is partially exposed to show an inside structure. The escalator E includes steps 1 on a central portion of which users get on, and a handrail belt 2 made of rubber which moves on both sides of the steps 1 with a speed same as a speed of the steps 1. The steps 1 and the handrail belt 2 are driven by a drive mechanism provided separately to the steps 1 and the handrail belt 2.

The handrail belt 2 is slidably fitted and supported on a guide 3 which is formed to be rail shaped on a topside (upper side of the steps 1) of the escalator E. Moreover, the handrail belt 2 is supported by a plurality of guide rollers 4 provided on a belt transporting path at an under side (lower side of the steps 1) of the escalator E, and is moved by a drive operation of a driving mechanism 6 provided with a driving wheel 5.

Several tens of guide rollers 4, for example more than 30 guide rollers, are provided on the transporting path of the handrail belt 2, and the handrail belt 2 is supported to be guided by an outer circumferential surface of the guide rollers 4 (for example, refer to JP-A 08-259162 (KOKAI)).

DISCLOSURE OF INVENTION

Various substances (such as dust) from hands of users are adhered to the handrail belt 2. These substances are transferred and adhered to the outer circumferential surface of the guider rollers 4 which come in contact with the handrail belt 2 during the movement of the handrail belt 2. Moreover, the substances adhered to the outer circumferential surface of the guide rollers 4 are adhered again to the handrail belt 2 and make the handrail belt 2 dirty.

On the other hand, the cleaning of the handrail belt is carried out by a cleaning company, and even when a surface of the handrail belt 2 is cleaned with the escalator E stopped, the substances adhered to the outer circumferential surface of the guide rollers 4 are transferred to the surface of the handrail belt 2 immediately after an operation of the escalator E is restarted.

Therefore, periodical cleaning of the guide rollers 4 and/or replacing by new cleaned guide rollers have been carried out. However, the cleaning and replacing jobs involve opening and closing of side surface panels and step panels which are cumbersome tasks. Moreover, each guide roller 4 being installed at an extremely narrow distance from the adjacent guide roller 4, such as a distance of 10 mm between the surfaces of two adjacent guide rollers, the cleaning and replacement jobs become difficult. Furthermore, it is not easy to carry out such jobs periodically for a large number (for example 20 to 50) of guide rollers 4.

Moreover, substances such as ink of a newspaper transferred to the handrail belt 2 from hands of the users are adhered to the guide rollers 4. Since such substances cannot be removed easily by wiping, methods such as scrubbing by a brush and scraping by using a knife have been adopted. Therefore, the work load is further increased and a working time also becomes long.

The present invention is made in view of the abovementioned problems, and an object of the present invention is to provide a film for cleaning guide rollers of escalator which enables to carry out the cleaning of the outer circumferential surface of the guide rollers in a short time by eliminating a job of removing the guide rollers.

To achieve the object of the present invention, there is provided a film for cleaning guide rollers of escalator which removes substances adhered to a plurality of guide rollers of an endless handrail belt which slides by driving of the guide rollers on a guide rail which is installed in an escalator, including a base film which is detachably stuck on a surface of the handrail belt, over a predetermined length in a direction of transporting of the handrail belt, a removing film layer which is stacked on the base film, and on a surface of which, an elastic member is formed, and by the drive of the guide rollers, the elastic member of the removing film layer which is in contact with the guide rollers is repulsed due to a friction with the guide rolls and removes the substances adhered to an outer circumferential surface of the guide rollers.

According to such arrangement, by repelling and capturing of the substances adhered to the outer circumferential surface of the guide rollers which guide the movement of the handrail belt, by the removing film layer of the film for cleaning stuck on the handrail belt which moves together with the drive of the escalator, it is possible to suppress to be small a work load of a worker, and to clean the outer circumferential surface of the guide rollers easily and rapidly. Moreover, by stopping the drive of the escalator at the time of a cleaning job, and by disposing the film for cleaning by peeling off from the handrail belt, it is possible to restart a normal operation (drive) of the escalator promptly.

Moreover, in the film for cleaning guide rollers of escalator according to the present invention, the removing film layer may have an elastic brush portion which wipes away the substances adhered to the outer circumferential surface of the guide rollers. According to such structure, by making an arrangement such that the elastic brush portion of the film for cleaning which moves together with the handrail belt scrapes the substances adhered to the outer circumferential surface of the guide rollers, it is possible to remove the substances forcibly and efficiently.

Moreover, in the film for cleaning guide rollers of escalator according to the present invention, the removing film layer may have a corrugate surface portion having elasticity, and which traps the substances adhered to the outer circumferential surface of the guide rollers. According to such structure, by making an arrangement such that the substances adhered to the outer circumferential surface of the guide roller are trapped by the corrugated surface portion of the film for cleaning which moves together with the handrail belt, it is possible to remove the substances forcibly and efficiently.

According to the present invention, by repelling and trapping the substances adhered to the outer circumferential surface of the guide rollers which guide the movement of the handrail belt by the removing film layer of the film for cleaning which is stuck on the handrail belt which turns along with the drive of the escalator, it possible to clean the outer circumferential surface of the guide rollers easily and rapidly while reducing the work load on a worker.

EXPLANATION OF REFERENCES

11 . . . Cleaning film, 12 . . . Base film, 13 . . . Adhesive layer, 14, 14A-14C . . . Brush portion, 14D-14F . . . Concavity and convexity surface portion, 15, 15A-15F . . . Removing film layer, 16 . . . Peeling sheet.

BEST MODE FOR CARRYING OUT THE INVENTION

A film for cleaning guide rollers of escalator according to an embodiment of the present invention is described below in detail by referring to the accompanying drawings.

Figure 1:
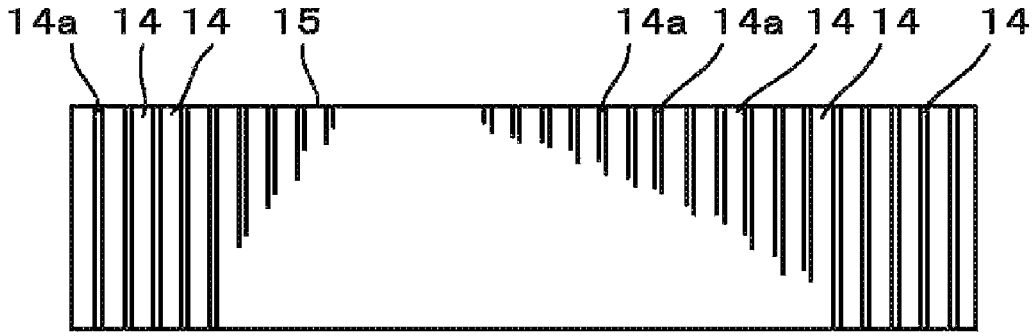
FIG. 1 is a plan view showing a cleaning film according to an embodiment of the present invention.
Figure 2:
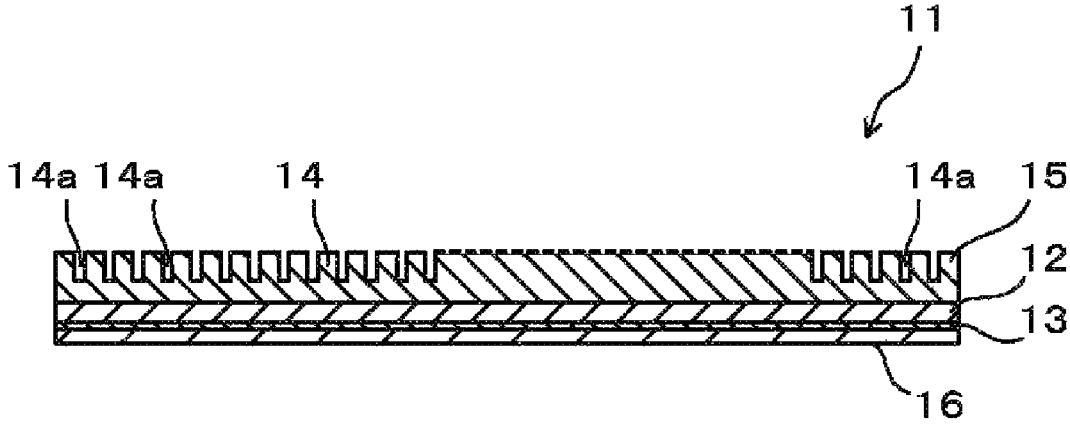
FIG. 2 is a cross-sectional view of the cleaning film shown in FIG. 1.
Figure 3:
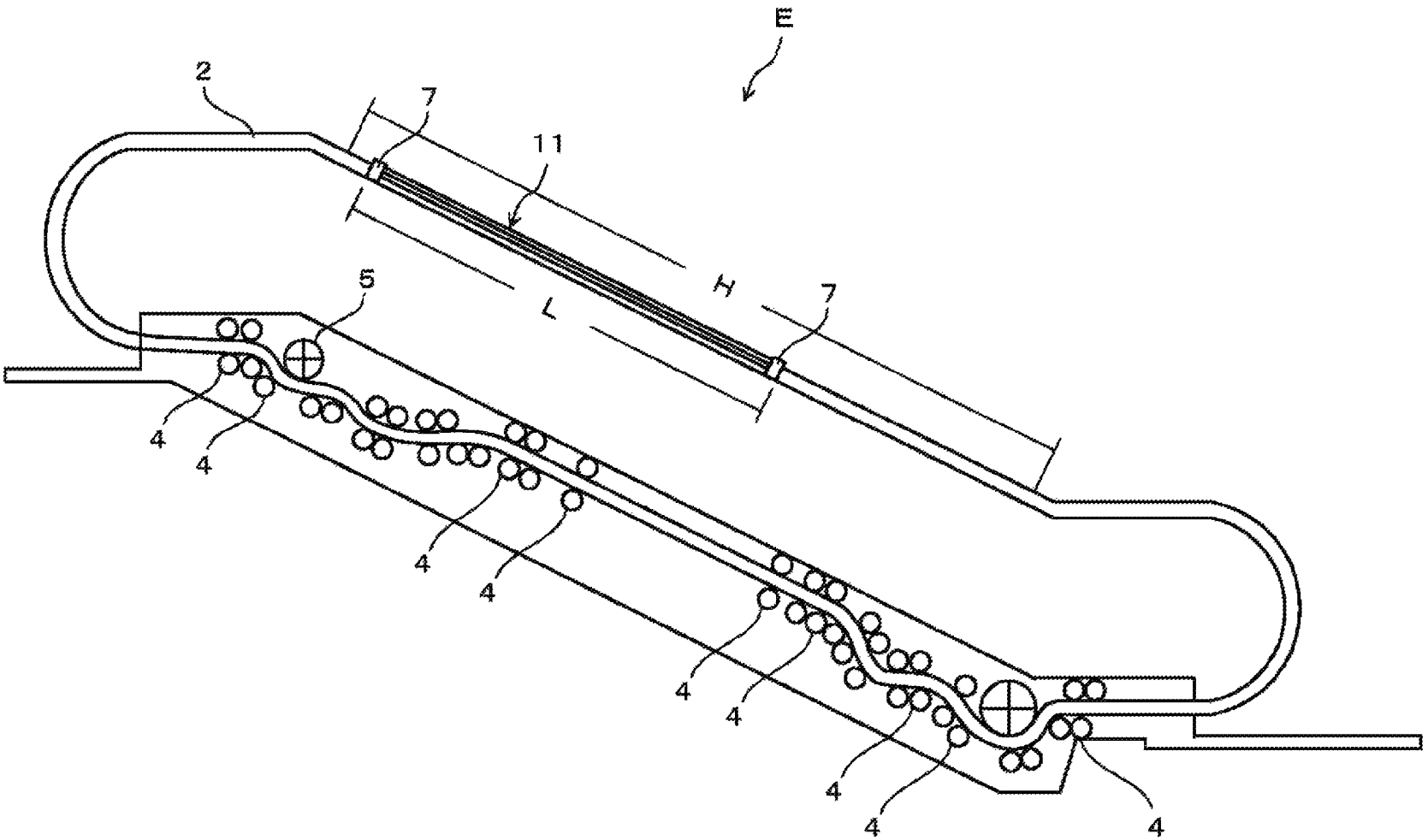
FIG. 3 is a conceptual diagram of an escalator showing a state in which the cleaning film of the embodiment is installed on a handrail belt.
Figure 4:
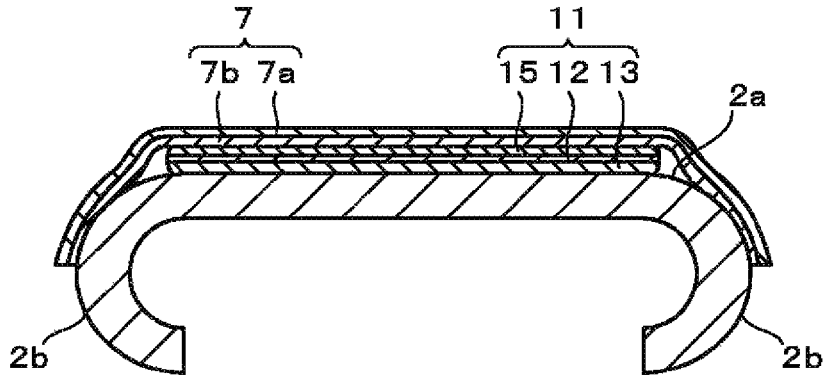
FIG. 4 is an enlarged cross-sectional view of main components in a state in which the cleaning film of the embodiment is installed on the handrail belt.
Figure 5:
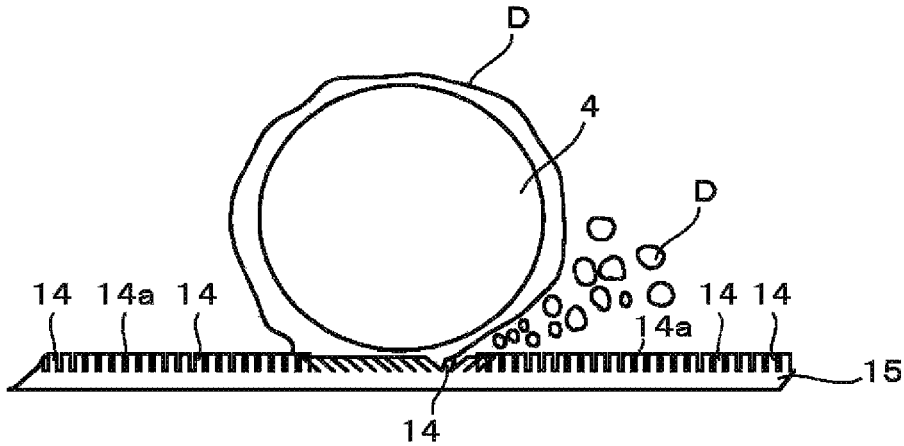
FIG. 5 is an explanatory diagram showing a state of cleaning of the guide rollers by the cleaning film.
Figure 6:
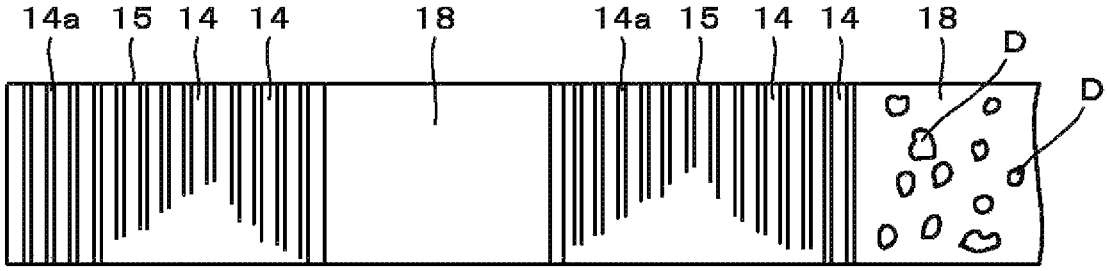
FIG. 6 is a plan view showing a main portion of a cleaning film according to another embodiment of the present invention.
Figure 7:
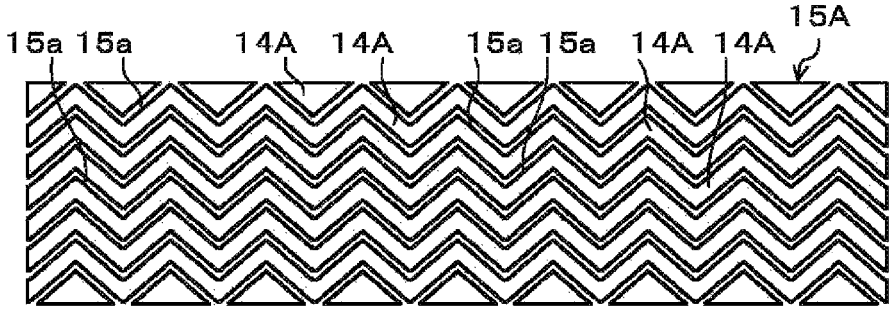
FIG. 7 is a plan view showing a main portion of a cleaning film according to still another embodiment of the present invention.
Figure 8:
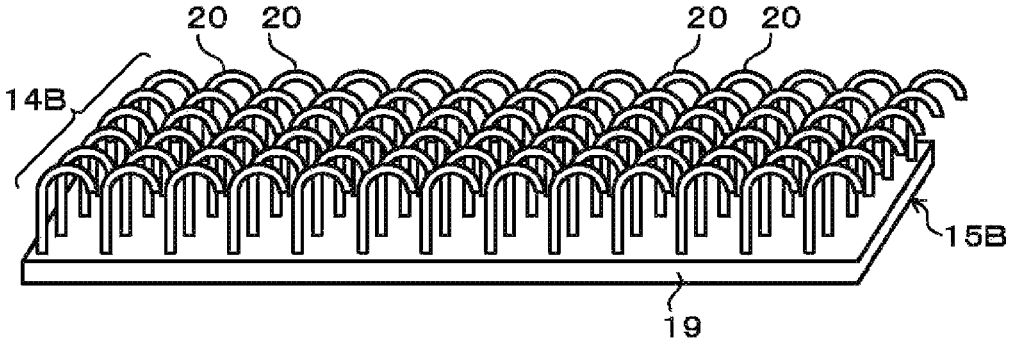
FIG. 8 is a perspective view showing a main portion of a cleaning film according to still another embodiment of the present invention.
Figure 9:
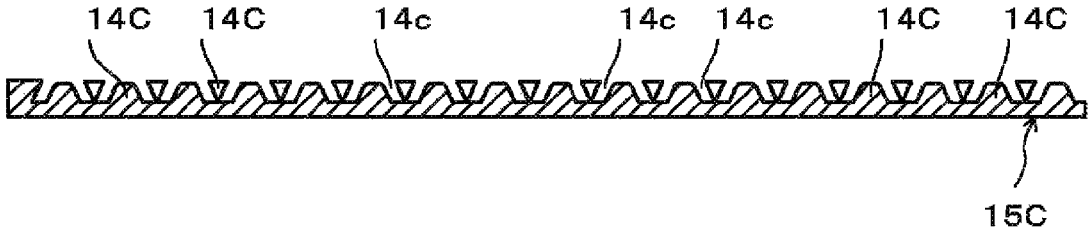
FIG. 9 is a cross-sectional view showing a main portion of a cleaning film according to still another embodiment of the present invention.
Figure 10:
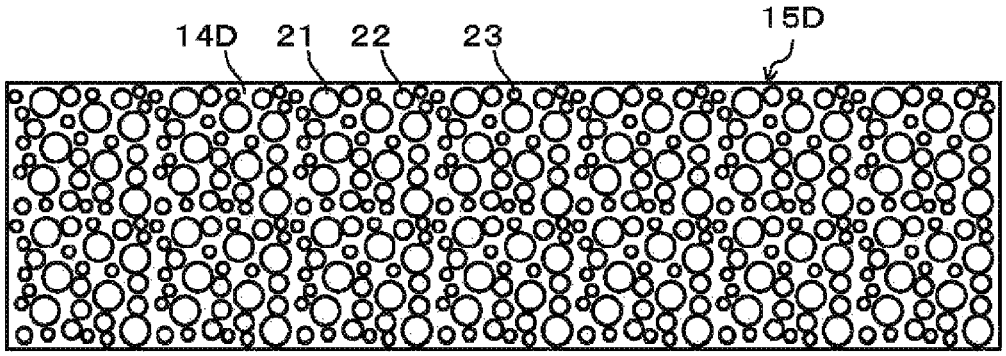
FIG. 10 is a plan view showing a main portion of a cleaning film according to still another embodiment of the present invention.
Figure 11:
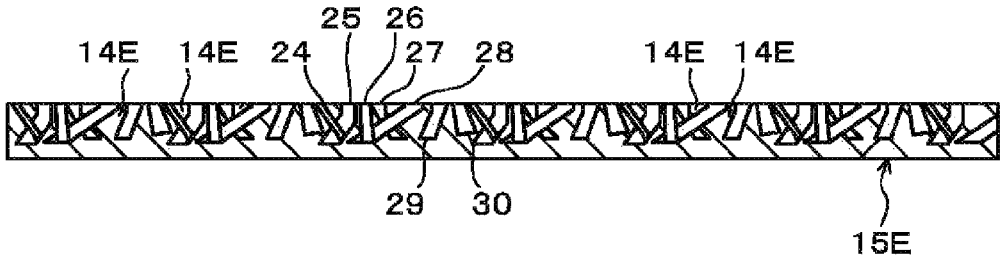
FIG. 11 is a cross-sectional view showing a main portion of a cleaning film according to still another embodiment of the present invention.
Figure 12:
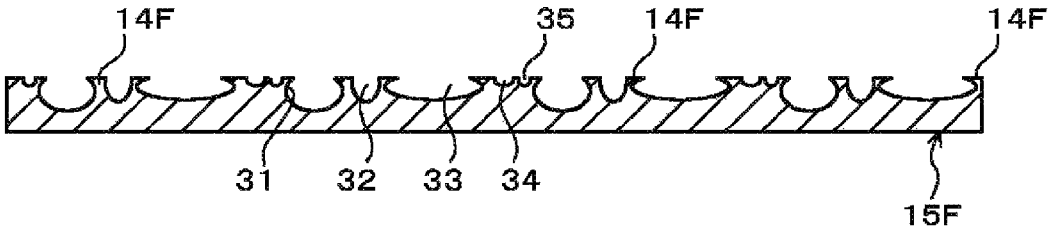
FIG. 12 is a cross-sectional view showing a main portion of a cleaning film according to still another embodiment of the present invention.
Figure 13:
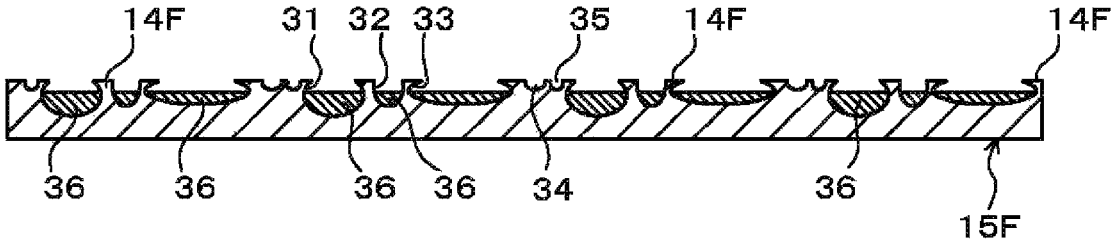
FIG. 13 is a cross-sectional view showing a main portion of a cleaning film according to still another embodiment of the present invention.

FIG. 1 is a plan view showing apart of a film for cleaning guide rollers of escalator according to the embodiment of the present invention. FIG. 2 is a cross-sectional view of the cleaning film shown in FIG. 1. FIG. 3 is a conceptual diagram of the entire escalator showing a state in which the cleaning film of the embodiment is installed on a handrail belt. FIG. 4 is a cross-sectional view of a main component showing a state in which the cleaning film of the embodiment is installed on the handrail belt. FIG. 5 is an explanatory diagram showing a state of cleaning of the guide rollers by the cleaning film. FIG. 6 is a plan view of a main portion showing a cleaning film according to another embodiment of the present invention. FIG. 7 is a plan view of a main portion showing a cleaning film according to still another embodiment of the present invention. FIG. 8 is a perspective view of a main portion showing a cleaning film according to still another embodiment of the present invention. FIG. 9 is a cross-sectional view of a main portion showing a cleaning film according to still another embodiment of the present invention. FIG. 10 is a plan view of a main portion showing a cleaning film according to still another embodiment of the present invention. FIG. 11 is a cross-sectional view of a main portion showing a cleaning film according to still another embodiment of the present invention. FIG. 12 is a cross-sectional view of a main portion showing a cleaning film according to still another embodiment of the present invention. FIG. 13 is a cross-sectional view of a main portion showing a cleaning film according to still another embodiment of the present invention.

In FIG. 1 and FIG. 2, a cleaning film 11 includes a base film 12 of, for example, an urethane resin base having high elasticized property, an adhesive layer 13 which is applied on one surface (lower surface) of the base film 12, and a removing film layer 15 on which a brush portion 14 as an elastic member is formed, which is stuck on the other surface (upper surface) of the base film 12. Natural rubber latex or synthetic rubber latex, which can be stuck to and peeled off from a surface of a handrail belt of the escalator E, is used as an adhesive of the adhesive layer 13.

The removing film layer 15 has on an upper surface, the brush portion 14 which flicks by scraping substances adhered to the surface of the handrail belt by repulsion when there is a friction with guide rollers. The removing film layer 15 is made of a film material which has, for example, hardness and elasticity, and a number of transversal grooves are formed on one surface side of the film material to create the brush portion 14. Furthermore, a peeling sheet 16 is stuck on the adhesive layer 13, and at the time of sticking the cleaning film 11 on the handrail belt 2, the peeling sheet 16 is peeled off from the adhesive layer 13.

The cleaning film 11 is a film having a long length, and a width of the cleaning film 11 is configured to be a size covering at least a flat portion 2*a* in the entire width of the handrail belt 2, as shown in FIG. 4. The width of the cleaning film 11 can be arbitrarily configured to be a size covering apart of circular portions 2*b* which continue on both sides of the flat portion 2*a*. Moreover, the cleaning film 11 is formed as described above, and is stuck on the handrail belt 2 as shown in FIG. 3 and FIG. 4 for cleaning an outer circumferential surface of guide rollers 4.

Figure 14:
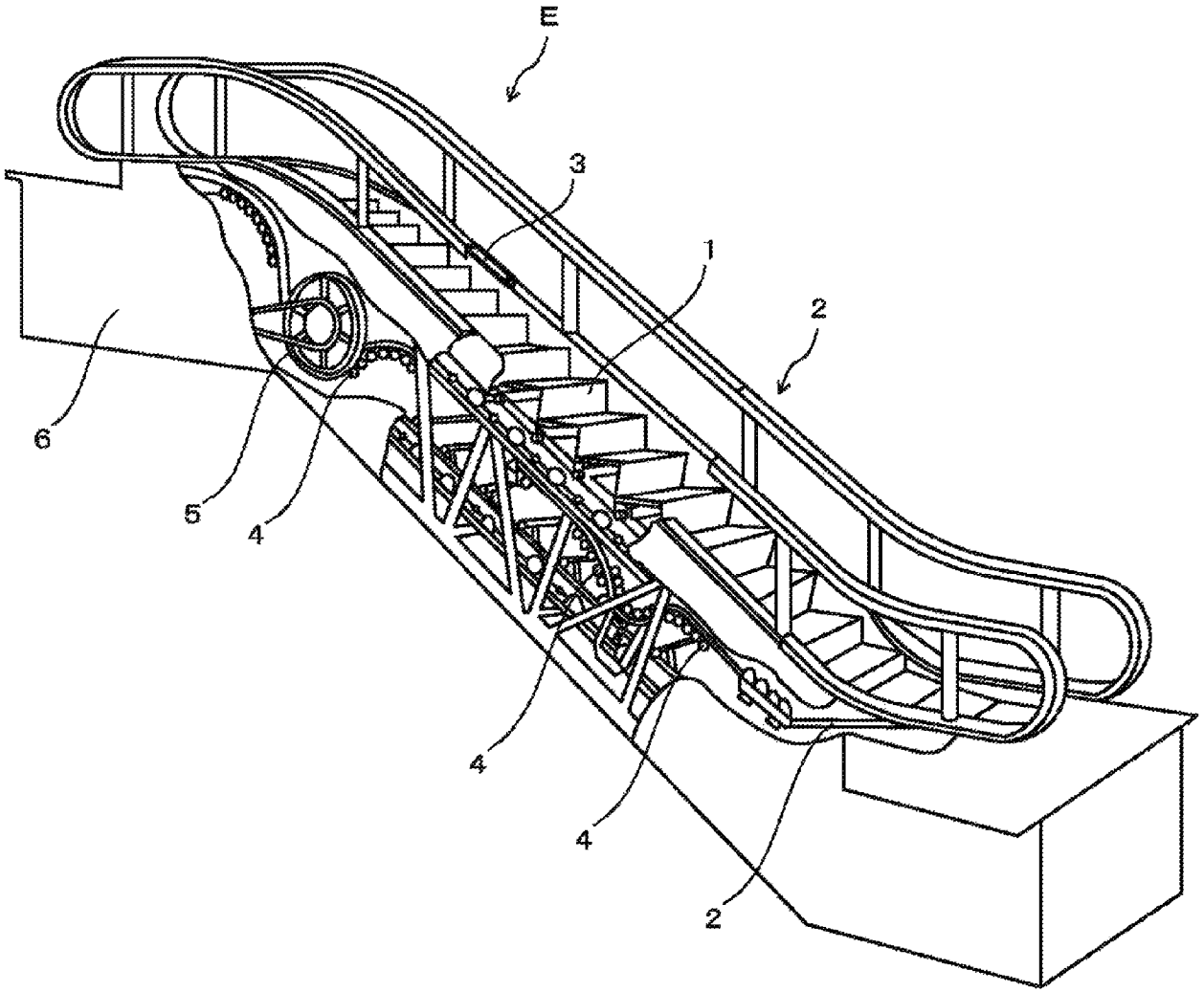
FIG. 14 is a perspective view showing conceptually an overall conventional escalator.

FIG. 3 is a conceptual diagram showing the overall escalator E including the handrail belt 2. The escalator E has an almost the same structure as an escalator shown in FIG. 14, and includes steps on which users get on, and the handrail belt 2 made of rubber which moves with a speed same as a speed of the steps. The steps and the handrail belt 2 are driven by a drive mechanism provided separately to the steps and the handrail belt 2. Same reference numerals are assigned to components same as in FIG. 14, and repeated description of such components is omitted.

Next, an operation of removing substances adhered to the outer circumferential surface of the guide rollers 4 by using the cleaning film 11 in the escalator E will be described below. First of all, the drive (movement) of the escalator E by the drive mechanism is stopped. The cleaning film 11 is stuck over a predetermined length L on a portion guided by a belt guide, in other words, a straight portion H (for example, about 3 m to 4 m long) of the handrail belt 2 of the escalator E which is at halt.

For sticking the cleaning film 11, first of all, the peeling sheet 16 is peeled off from the adhesive layer 13, and the adhesive layer 13 is stuck to the surface of the handrail belt 2. Accordingly, the cleaning film 11 having the removing film layer 15 on the base film 12 is closely fixed on the upper surface of the handrail belt 2 as shown in FIG. 4.

Next, both end portions of the cleaning film 11 (a front end portion and a rear end portion in a direction of transporting of the handrail belt) fixed to the handrail belt 2 in such manner are adhered and fixed by a fixing film 7 of a width of about 10 cm for example. The fixing film 7 is a urethane-based resin film of a thickness of about 60 μm, and includes a film substrate 7*a* and an adhesive layer 7*b* which can be adhered to an upper surface of the cleaning film 11 and the upper surface of the handrail belt 2. The adhesive layer 7*b* can be peeled off from the upper surface of the handrail belt 2.

When the cleaning film 11 is adhered and fixed to the handrail belt 2 in such manner, an operation of the drive mechanism of the escalator E is started. By starting the operation, the handrail belt 2 is guided by the guide rollers 4 on a lower side of the steps and the belt guide on an upper side of the steps, and transported. At a portion where the guide rollers 4 make a contact with the cleaning film 11, the brush portion 14 of the removing film layer 15 makes a contact with the outer circumferential surface of the guide rollers 4 due to a strong thrust as shown in FIG. 5.

Upon the strong thrust being exerted, the substance (solid material) D including oil adhered and stuck to the outer circumferential surface of the guide rollers 4 is scraped by resiliency of the brush portion 14 and is flicked away as shown in FIG. 5. As a result, the substances on the outer circumferential surface of the guide rollers 4 are removed forcibly and efficiently without cumbersome manual work. For removing the substances adhered, the handrail belt 2 is made to go round along the guide rollers 4 and the belt guide for a number of times by the drive mechanism.

Upon confirming that the substances on the outer circumferential surface of the guide rollers 4 are removed, the operation of the drive mechanism is stopped when the cleaning film 11 has reached a position at an upper portion of the steps. Next, the fixing film 7 is peeled off from the surface of the handrail belt 2 together with the cleaning film 11, and disposed of. Thereafter, by restarting the drive mechanism, and making the handrail belt 2 go round, it is possible to restart the normal operation as the escalator E having the cleaned handrail belt 2.

The brush portion 14 may have a transversal grooves pattern form on the entire surface of the removing film layer 15, with each groove having a same length and a same depth as shown in FIG. 1. Apart from this, as shown in FIG. 6, the brush portion 14 may be divided into a plurality of areas, and an area of a sticky material 18 may be provided between the two areas.

In this case, it is possible to make the solid substances D flicked by the brush portion 14 to be adsorbed in a surface of the sticky material 18 adjacent in a direction opposite to a direction of advancement of the brush portion 14. Consequently, it is possible to avoid contamination of the outer circumferential surface of the guide rollers 4 by adhering again of the substances D which are flicked. Moreover, even when the substances D which are flicked are adhered again to the outer circumferential surface of the guide rollers 4, by flicking once again by the next brush portion 14 it is possible to make the substances D to be adsorbed assuredly in the sticky material 18.

FIG. 7 is a plan view showing another embodiment of a removing film layer. A removal film layer 15A of this embodiment has a plurality of grooves 15*a* in a zigzag form in the direction of transporting (longitudinal direction) of the handrail belt 2 formed on an upper surface portion, thereby forming a brush portion 14A which is broad-crested. The removing film layer 15A is made of a urethane-based resin film having high elasticized property as described earlier. Therefore, the removing film layer 15A comes in contact with the substances D such as dirt adhered to the outer circumferential surface of the guide rollers 4 by the movement of the cleaning film, and it is possible to flick the substances D.

FIG. 8 is a perspective view showing another embodiment of a removing film layer. A removing film layer 15B of this embodiment is a layer in which a brush portion is formed by embedding a plurality of brushes 20 having a shape of English alphabet J turned up-side-down on a substrate 19 which is made of an urethane-based resin film. It is desirable that the brushes 20 are made of a slightly hard elastic material and the plurality of brushes are disposed in an orderly manner at an equal interval. Therefore, a tip of each brush 20 acts to scrape and flick the substances D adhered to the outer circumferential surface of the guide rollers 4.

Instead of arranging each brush 20 at an equal interval from the other brush 20, the brushes may be arranged at random. Accordingly, a contact of a front-tip portion with almost the entire outer circumferential surface the guide roller 4 becomes possible, and it is possible to avoid assuredly any substance D remaining without being removed.

FIG. 9 is a cross-sectional view showing another embodiment of the removing film layer. A removing film layer 15C of this embodiment, which is a modified embodiment of FIG. 1 and FIG. 2, has a brush 14C which is formed by cutting a plurality of transversal grooves 14*c* in a film material having a hardness and resilience from an upper surface thereof. The transversal grooves 14*c* are formed in pairs of two on the upper surface of the film with the two transversal grooves 14*c* cut in an inclined direction intersecting mutually. Each pair of transversal grooves 14*c* is defined as one set, and a plurality of such sets is formed. Accordingly, an upper edge of the brush portion 14C which is remained due to the cutting of the grooves in the inclined direction becomes a cutting edge. Therefore, it is possible to scrape effectively and efficiently the substances adhered to the outer circumferential surface of the guide rollers 4 by the brush portion 14C.

FIG. 10 is a plan view showing still another embodiment of a scraping layer of the removing film layer. On a removing film layer 15D of this embodiment, a plurality of round holes 21, 22, 23 having three different sizes are disposed with a certain pattern on a film material having a hardness and resilience. A portion of the film material excluding the round holes 21, 22, and 23 form a concavity and convexity portion 14D together with the round holes 21, 22, and 23. Accordingly, when each of the round holes 21, 22, and 23 comes in contact with the outer circumferential surface of the guide roller 4, an edge portion in the form of a cutting blade thereof scrapes the substances D adhered to the outer circumferential surface of the guide roller 4, and traps in the round holes 21, 22, and 23.

FIG. 11 is a cross-sectional view showing still another embodiment of the removing film layer. According to a removing film layer 15E of this embodiment, a plurality of groove holes 24 to 30 of various types having different sizes and shapes in different directions of depth from an upper surface are disposed with a certain pattern on a film material having a hardness and resilience from an upper surface thereof. A portion of the film material excluding the groove holes 24 to 30 form a concavity and convexity surface portion 14E together with the groove holes 24 to 30, and function as a brush portion 14E. Accordingly, when the groove holes 24 to 30 come in contact with the outer circumferential surface of the guider roller 4, edge portions in the form of a cutting blade thereof scrape the substances D adhered to the outer circumferential surface of the guide roller 4, and trap the substances inside the groove holes 24 to 30.

FIG. 12 is a cross-sectional view showing still another embodiment of the removing film layer. According to a removing film layer 15F of this embodiment, a plurality of wedge holes 31 to 35 of various types having different sizes are disposed with a certain pattern on a film material having a hardness and resilience. A portion of the film material excluding the wedge holes 31 to 35 form a concavity and convexity surface portion 14F together with the wedge holes 31 to 35, and function as a brush portion 14F. Accordingly, when the wedge holes 31 to 35 come in contact with the outer circumferential surface of the guide roller 4, edge portions in the form of a cutting blade thereof scrape the substances D adhered to the outer circumferential surface of the guide roller 4, and trap inside the wedge holes 31 to 35.

Moreover, by accommodating (applying) an sticky material 36 at a bottom portion of the wedge holes 31 to 35 as shown in FIG. 13, it is possible to trap immediately on the sticky material 36 the solid substances D which is captured from the outer circumferential surface of the guide roller 4. Consequently, it is possible to prevent assuredly the substances D captured from going out of the wedge holes 31 to 35. Moreover, the substances D are disposed of simultaneously by disposing by peeling off the cleaning film 11 from the handrail belt 2.

In this manner, in the embodiment, by sticking the cleaning film on the endless handrail belt which is guided and transported by the guide rollers 4 and the belt guide, and by transporting by driving the handrail belt, it is possible to capture upon flicking by scraping the substances adhered to the outer circumferential surface of the guide rollers by the removing film layer without exerting a substantial work load on a worker, and it is possible to improve remarkably an efficiency of cleaning the outer circumferential surface of the guide rollers as compared to a conventional method.

INDUSTRIAL APPLICABILITY

The present invention has an effect of eliminating a job of removing the guide rollers, and a capability to carry out the cleaning of the outer circumferential surface of the guide rollers in a short time, and is useful for a film for cleaning guide rollers of escalator which is used for cleaning guide rollers which guide a handrail belt.

What is claimed is:

1. A film for cleaning a guide roller of an escalator, the guide roller driving an endless handrail belt to be slid on a guide rail installed in the escalator, the film comprising:

a base film configured to be detachably stuck on a surface of the handrail belt over a predetermined length in a moving direction of the handrail belt;

a removing film formed on the base film, the removing film having an elastic member formed on a surface thereof, the elastic member contacting with the guide roller to remove substances adhered to an outer circumferential surface of the guide roller by a friction caused by driving the guide roller; and an adhesive film formed on the base film and adjacent to the removing film in opposite direction of the moving direction, the adhesive film being configured to absorb the substances removed by the elastic member from the guide roller.

2. The film for cleaning a guide roller of an escalator according to claim 1, wherein the removing film has an elastic brush portion to flick the substances adhered to the outer circumferential surface of the guide roller.

3. The film for cleaning a guide roller of an escalator according to claim 1, wherein the removing film has a concavity and convexity surface portion having elasticity to trap the substances adhered to the outer circumferential surface of the guide roller.

* * * * *